United States Patent [19]

Benisek et al.

[11] 4,448,817

[45] May 15, 1984

[54] TEXTILE FINISHING OF KERATINOUS ARTICLES

[75] Inventors: Ladislav Benisek, Burley-in-Wharfedale; Penelope C. Craven, Shipley, both of England

[73] Assignee: Wool Development International Limited, London, England

[21] Appl. No.: 428,950

[22] Filed: Sep. 30, 1982

Related U.S. Application Data

[63] Continuation-in-part of Ser. No. 222,943, Jan. 6, 1981, abandoned.

[51] Int. Cl.[3] ..... B05D 3/02

[52] U.S. Cl. ..... 427/412; 427/338; 427/342; 427/389; 427/393.3; 427/393.4

[58] Field of Search ..... 8/127.51, 127.5, 127.6, 8/128 R, 128 A, DIG. 5, 11, 112; 424/72, DIG. 1, DIG. 2; 427/389, 393.3, 393.4, 412, 338, 342

[56] References Cited

U.S. PATENT DOCUMENTS 4,121,902 10/1978 Guise ..... 8/128 A

FOREIGN PATENT DOCUMENTS 1372694 11/1974 United Kingdom .
1379752 1/1975 United Kingdom .
1419306 12/1975 United Kingdom .
1423342 2/1976 United Kingdom .
1547958 7/1979 United Kingdom .

*Primary Examiner*—Thurman K. Page
*Attorney, Agent, or Firm*—Andrew D. Maslow

[57] ABSTRACT

A method finishing keratinous textile articles, for example wool fabrics, which comprises treating the articles with an anti-felt polymer for example isocyanate functional or bunte salt functional polymers, and a polymer of chlorinated ethylenically unsaturated monomer, for example polyvinyl chloride, polyvinylidene chloride, polypropylene, and dichlorobutadiene. Thereafter, the articles are treated with an anionic titanium or zirconium complex at low pH. Textiles so treated exhibit both shrink-resistant and flame-retardant properties.

10 Claims, No Drawings

TEXTILE FINISHING OF KERATINOUS ARTICLES

This is a continuation-in-part of application Ser. No. 222,943 filed Jan. 6, 1981 now abandoned.

This invention relates to a method of finishing keratinous fibres to render textile articles made from such fibres resistant to area felting shrinkage and flame-retardant.

Keratinous fibers, e.g. wool, are naturally flame retardant, but increasing stringency of regulations in various countries has meant that certain constructions of wool fabrics, or fabrics for certain end uses, e.g. in aeroplanes, and for clothing to provide protection against heat and flames, require an additional flame retardancy treatment. The titanium and zirconium flame retardancy treatments described in our U.K. Pat. Nos. 1,372,694 and 1,379,752 have proved eminently suitable for improving the flame retardancy of wool textiles to meet the standards imposed by various legistlative bodies.

The above treatments are fast to machine washing but, as is well-known, wool textiles tend, according to construction, to felt when washed in a machine and hence shrink. Many methods for rendering wool textiles shrink resistant are available but are in general not compatible with the above treatments because of curing difficulties at low pH values, or the shrink-resist polymer applied adds to the fuel contribution, i.e. increases the combustibility, of the textile, thereby at least partly negating the flame retardancy treatment. Certain shrink-resist processes involving chlorination are not incompatible with the above treatments, nor do they add significantly to the fuel value of the textile, but are generally not desirable because chlorination lowers the water repellency and causes difficulties with dyestuffs. There is also the disadvantage of an extra processing step involving noxious chemicals.

According to the present invention there is provided a method for finishing keratinous textile articles which comprises treating the articles with an anti-felt polymer and a polymer of a chlorinated ethylenically unsaturated monomer, and thereafter treating the articles with an anionic titanium or zirconium complex at low pH.

The process is generally applicable to water-soluble curable shrink-resist polymers and prepolymers and especially those having ionic charges. Isocyanate functional polymers, and especially blocked isocyanate polymers, are preferred particularly water-soluble blocked isocyanates such as polycarbomyl sulphonates. Examples of suitable polymers include polycarbamoyl sulphonates, bunte salt polymers, the amphoteric polymers of our British Pat. No. 1,547,958, and anionic acrylate emulsions. Cationic polymers such as a polyamideephichlorhydrin polymer, or azetidinium polymers, may also be used provided they are compatible with the chlorinated polymer emulsion used, if a cationic emulsion is employed. When the preferred chlorinated polymer emulsions are used, which are anionic, it is preferred to use anionic anti-felt polymers. Especially preferred are the polycarbomyl sulphonates described in U.K. Pat. No. 1,419,306. These may conveniently be prepared from polymeric di- or poly-isocyanates by treatment with sodium bisulphite.

Preferred polycarbomyl sulphonates have polyoxyalkylene, e.g. polypropylene oxide, backbones and three carbomoyl sulphonate groups. Particularly preferred compounds have the following structure:

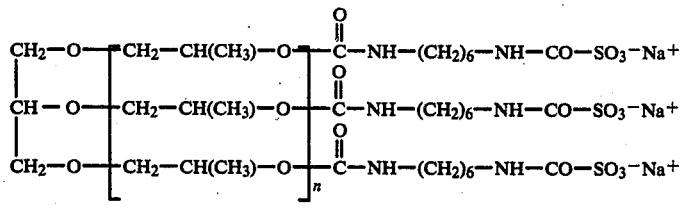

wherein n is about 13. Such a compound is available commercially under the name "Synthaprett BAP" (Bayer).

Preferred curable polymeric materials have a polymeric chain backbone and at least two thiosulphate groups per molecule. The chain may advantageously be a polyoxyalkylene, e.g. polyoxypropylene, chain. Particularly preferred materials of this type have the following structural formula:

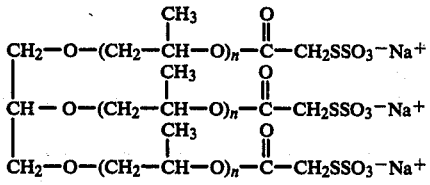

where n is about 13.

Prepolymers of this type are disclosed in our British Pat. No. 1,423,342. A suitable compound is available commercially under the name "Lenkrolan SHR3." It has been found that this type of polymer gives a very good handle to the treated fabric, especially when used with the "Neoprene" polymer mentioned hereinafter.

The polymer of a chlorinated ethylenically unsaturated monomer combines with the anti-felt polymer to give a shrink-resist effect, and thus allows less polymer to be used than would be necessary if it were used alone. Since the chlorinated polymers in general do not add to the fuel value of the textile and may even impart a degree of flame retardance, a net lowering of the fuel contribution of the shrink-resist treatment can be obtained. The surprising properties of these polymers lie in their capacity both to enhance the shrink-resist qualities of other polymers, particularly polycarbomyl sulphonates and bunte salts, and enhance the flame retardant properties of the titanium and zirconium complexes.

The chlorinated polymers which may be used include in general, polyvinyl chloride, polyvinylidene chloride, polychloroprene, and dichlorobutadiene. In general the higher the chlorine content of the polymer the better its flame retardancy characteristics, but this criterion is affected by other factors. Most of these polymers are too hard alone and therefore are available as copolymers with such monomers as acrylonitrile or methacrylic acid. The latter add to the fuel value of the copolymer and in certain cases may render the polymer unsuitable. In general most commercially available polyvinylchloride compositions are unsuitable for this reason. We have found that for augmenting the shrink-resist effect (thereby allowing the use of less anti-felt polymer) while keeping the fuel contribution as low as possible, the preferred chlorinated polymers are Polidene 33-041 (a polyvinylidene chloride copolymer—Scott Bader Co. Ltd.) and Neoprene 400 (a copolymer of polychloroprene and 2,3-dichloro-1,3-butadiene—Du Pont), especially the latter.

The treatment with titanium or zirconium may be carried as described in our above U.K. patents. In brief the metal are applied, preferably by exhaustion as anionic complexes with fluoride, citrato, or tartrato ions at a PH in the range 1 to 4. The titanium treatment is more effective, weight for weight, than the zirconium treatment but leads to a slight yellow colouration and should generally be used only with dark shades or where colouration is immaterial.

The quantities of agents may vary within wide limits subject to the desired degree of shrink-resistance, the flame retardancy required, and such factors as the substrate, coreactants, and so on. Thus in general the anti-felt prepolymer may be applied in the range 0.1 to 10% oww, preferably 0.2 to 2%, the lowest amount compatible with adequate shrink-resistance being chosen. The chlorinated polymer may be used in amounts of from 1% to 10% with 1. to 4% being preferred. The titanium or zirconium treatments may be applied in the ranges of 0.5% to 2.5% or 1% to 5% respectively (calculated as oxide) again depending on the substrate and the level of flame retardancy required.

The keratinous fibres may be for example mohair, alpaca, vicuna, angora, or especially wool, and the textile article may be in the form of loose stock, silvers, slubbings, rovings, yarns, fabrics, made-up garments or carpets, preferably fabrics.

The shrink-resist treatment may be carried out in any suitable manner e.g. exhaustion, dipping, spraying or padding, preferably the latter, and the flame retardancy treatment is preferably carried out by exhaustion from long liquor.

The invention will be illustrated further by the following examples. The test methods used were as follows:

FELTING SHRINKAGE

This was determined after 1 hour and 3 hours in an International Cubex Washing Machine, using a phosphate buffer at PH7 and 40° C. with liquor ratio 15:1, and total load 1 kg made up with polyester make-weights. The results are expressed as percentage area felting shrinkage.

FLAME-RESISTANCE TEST

This was evaluated according to Federal Aviation Regulations 25.853b, a vertical flame test with a 12 second ignition time. To meet this standard the after-burning time should not exceed 15 seconds and the char length should not be more than 8 inches, tested in both the warp and weft directions. Wash fastness of the flame retardancy effect is determined after 10 and 20 washes in a Kenmore Model 21900 washing machine at 40° C., liquor ratio 1:36, load 1.8 kg using 90 g "Bold" washing power per 65 liters.

EXAMPLES 1 TO 10

Lankrolan SHR3 and Neoprene 400 were padded onto a wool serge fabric. The fabric was dried and then cured at 150° C. for 5 minutes. Zirconium flame retardant treatment was applied by immersing the fabric at 1:20 liquor ratio in a bath containing 10% oww HCl (37%) 4% oww citric acid and 6% oww $K_2TiF_6$ for 30 minutes at 60° C., liquor ratio 1:30, by rinsing and drying.

The area felting shrinkage of the fabric after 3 hours test; and the FAR 25.853B test results are given in Table 1 below for a variety of component concentrations.

TABLE 1

SHRINK-RESISTANCE AND FLAME-RETARDANCE

| EXAMPLES | Treatment | Area Felting Shrinkage in % 3 Hrs. | Flame-Retardance F.A.R. 25.853b: Before Washing, Warp B.T. | Before Washing, Warp C.L. | Before Washing, Weft B.T. | Before Washing, Weft C.L. | After 10 Washes at 40° C., Warp B.T. | After 10 Washes at 40° C., Warp C.L. | After 10 Washes at 40° C., Weft B.T. | After 10 Washes at 40° C., Weft C.L. |
|---|---|---|---|---|---|---|---|---|---|---|
| | Untreated 100% wool-twill fabric | 18 | >15 | F.L. | >15 | F.L. | — | — | — | — |
| 1. | 0.5% Lankrolan SHR3*/Zirpro | 17 | >15 | F.L. | >15 | F.L. | — | — | — | — |
| 2. | 1.0% Lankrolan SHR3*/Zirpro | 14 | >15 | F.L. | >15 | F.L. | — | — | — | — |
| 3. | 1.5% Lankrolan SHR3*/Zirpro | 8 | >15 | F.L. | >15 | F.L. | — | — | — | — |
| 4. | 2.0% Lankrolan SHR3*/Zirpro | 4 | >15 | F.L. | >15 | F.L. | — | — | — | — |
| 5. | 0.3% Lankrolan SHR3, 2% Neoprene 400*/Zirpro | 6 | 1.0 | 1.5 | 4.0 | 1.5 | 13.0 | 4.0 | 3.0 | 3.0 |
| 6. | 0.3% Lankrolan SHR3, 3% Neoprene 400*/Zirpro | 4 | 3.0 | 1.5 | 5.0 | 1.5 | 18.0 | 5.0 | 9.0 | 3.5 |
| 7. | 0.6% Lankrolan SHR3, 2% Neoprene 400*/Zirpro | 4 | 4.0 | 1.5 | 9.0 | 2.0 | 14.0 | 5.0 | 19.0 | 5.5 |
| 8. | 0.6% Lankrolan SHR3, 2% Neoprene 400*/Zirpro | 3 | 3.0 | 2.0 | 4.0 | 1.5 | 12.0 | 4.5 | 3.0 | 3.0 |
| 9. | 0.9% Lankrolan SHR3, 2% Neoprene 400*/Zirpro | 2 | 4.0 | 1.5 | 8.0 | 2.0 | 8.0 | 3.5 | 10.0 | 4.0 |
| 10. | 0.9% Lankrolan SHR3, 2% Neoprene 400*/Zirpro | 2 | 0 | 1.5 | 5.0 | 1.5 | 7.0 | 3.5 | 12.0 | 3.5 |

All concentrations based on solids and on the weight of wool.
Lankrolan SHR3 - 40% solids content
Neoprene 400 - 50% solids content
B.T. — burning time in seconds
C.L. — char length in inches
F.L. — full length (12 inches)
*pad-dry-cure (5 minutes, 150° C.)
Zirpro - 10% HCl 37%, 4% citric acid, 6% $K_2TiF_6$, 30 minutes at 60° C. liquor ratio 1:30.

The Lankrolan SHR3 treatment is not compatible with the titanium flame-retardant treatments (Examples Nos. 1–3). The addition of Neoprene 400 to the Lankrolan SHR3 not only makes the shrink-resist treatment compatible with the flame retardant treatment but is also allows the lower concentration of Landrolan SHR3 to be used to achieve adequate shrink-resistance (Examples Nos. 4–10). In other words the incorporation of Neoprene 400 imparts flame-resistance to Lankrolan SHR3 and it also acts as a shrink-resist agent.

applied as in Example 11. The results are given in the Table 2 below.

TABLE 2

| Ex. No. | Treatment | Area Felting Shrinkage % 1 hr. | 3 hrs. | Flame resistance FAR 25.853b Before Washing BT | CL | After 10 w. BT | CL | After 20 w. BT | CL |
|---|---|---|---|---|---|---|---|---|---|
| | Fabric 1 (Wool serge, 197 g/m$^2$) Untreated | 6 | 40 | >15 | F.L. | >15 | F.L. | >15 | F.L. |
| 2 | 0.75% Synth. BAP. 1.75% Polidene 33-041 | 3 | 1 | 0 | 5 | 0 | 5.5 | 0 | 6.0 |
| 3 | 0.25% Synth. BAP. 2.25% Polidene 33-004 | 2 | 9 | −2 | 4.5 | −1 | 4.5 | 0 | 5 |
| | *Fabric 2 (wool upholstery fabric 354 g/m$^2$) Untreated | 31 | 68 | >15 | F.L. | — | | — | |
| 4 | 0.75% Synth. BAP + 0.5% $NaHCO_3$ + 1.75% Polidene 33-041 | 3 | 5 | 2.5 | 3.5 | — | | — | |
| 5 | 1.0% Synth. BAP + 0.5% $NaHCO_3$ + 1.5% Polidene 33-041 | 3 | 4 | 10 | 5 | — | | — | |
| 6 | 0.5% Synth. BAP + 0.5% $NaHCO_3$ + 2% Polidene 33-004 | 1 | 10 | 2.5 | 2.5 | | | | |
| | *Fabric 3 (wool upholstery fabric 475 g/m$^2$) Untreated | 13 | 24 | >15 | F.L. | — | | — | |
| 7 | 1.0% Synth. BAP + 0.5% $NaHCO_3$ + 1.5% Polidene 33-041 | 1 | 1 | 1 | 1.5 | — | | — | |
| 8 | 0.75% Synth. BAP. + 0.5% $NaHCO_3$ + 1.75% Polidene 33-021 | 1 | 5 | 2.5 | 1.5 | — | | — | |
| | *Fabric 4 (wool upholstery fabric 483 g/m$^2$) Untreated | 10 | 20 | >15 | F.L. | | | | |
| 9 | 0.5% Synth. BAP + 0.5% $NaHCO_3$ + 2% Polidene 33-041 | 0 | −1 | 1 | 1.5 | | | | |

B.T. Burning time (in seconds)
C.L. Char length (in inches)
F.L. Full length (12 inches)
*The upholstery fabrics were not tested for flame resistance after washing.

EXAMPLE 11

Synthappret BAP(0.4% oww) $NaHCO_3$(1% oww) and Neoprene 400 (3%) were padded onto a wool serge fabric. The fabric was dried and then cured at 140° C. for 5 minutes. Zirconium flame retardant treatment was applied by immersing the fabric at 1:20 liquor ratio in a bath containing 10% oww HCl (37%), 4% oww citric acid and 8% oww $K_2ZrF_6$ for 30 minutes at 70° C., followed by rinsing and drying.

The area felting shrinkage of the fabric was zero after 1 hour and 2% after 3 hours test; and the fabric passed the FAR 25.853b test in both the warp and weft directions. It was also observed that the smooth drying properties of the fabric given this treatment were exceptionally good, and that the spray rating, according to B.S. 3702, was unchanged by the treatment. A similar fabric given a chlorination treatment showed a marked deterioration in spray rating.

EXAMPLES 12 TO 19

In these examples the Synthappret and Polidene were applied to various fabrics by a pad-dry-cure route and the "Zirpro" zirconium flame retardant treatment was The spray rating of both the treated and untreated samples was 3 in each case.

EXAMPLE 20

An all-wool gaberdine fabric, 270 g/m$^2$, was treated with 1.25% Synthappret BAP, 1.25% Neoprene 400 and 1% $NaHCO_3$ by the pad-dry-cure technique, curing being achieved by heating to 150° C. for 5 minutes. Thereafter, in a separate bath, the fabric was given a Zirpro treatment with 10% HCl (37%), 4% citric acid, and 6% $K_2TiF_6$ for 30 minutes at 70° C. at a fabric-to-liquor ratio of 1:25.

The results are given in Table 3 below.

EXAMPLE 21

Example 20 was repeated with the inclusion of 3% FC214 (a fluorocarbon supplied by the 3M Company) in the Zirpro treatment.

As can be seen from Table 3 below, this resulted in a fabric which was shrink-resistant, flame retardant, and oil-and water-repellant, the first three properties being fast to severe washing at 60° C. and the last fast to at least 20 washes at 40° C.

TABLE 3

EVALUATION OF MULTI-PURPOSE FINISHES ON A 100% WOOL GABERDINE FABRIC, 270 g/m$^2$

| Example No. | Treatment | Felting Shrinkage 3 hr Cubex | 3 hr Cubex + A 25 W 60 | Flame-retardance B.S. 3119/3120 B.W. | A 20 W 40 | A 25 W 60 | Oil Rating AATCC 118-1975 B.W. | A 20 W 40 | A 25 W 60 | Spray Rating B.S. 3702 B.W. W.I. | R | A 20 W 40 W.I. | R | A 25 W 60 W.I. | R |
|---|---|---|---|---|---|---|---|---|---|---|---|---|---|---|---|
| | Untreated | 20% | 63.7% | Fail | Fail | Fail | 0 | — | — | 12.9% | 2 | — | — | — | — |
| 20 | 1.25% Synthappret BAP, 1.25% Neoprene 400, 1% $NaHCO_3$/Zirpro 1 | | 0.3% | Pass | Pass | Pass | 0 | | | 13.8% | 2 | — | — | — | — |
| 21 | 1.25% Synthappret BAP, 1.25% Neoprene 400, | 0 | 0 | Pass | Pass | Pass | 6 | 6 | 5 | 0.3% | 5 | 0.8 | 5 | 13.9 | 2 |

TABLE 3-continued

EVALUATION OF MULTI-PURPOSE FINISHES ON A 100% WOOL GABERDINE FABRIC, 270 g/m²

| Example No. | Treatment | Felting Shrinkage 3 hr Cubex | Felting Shrinkage 3 hr Cubex + A 25 W 60 | Flame-retardance B.S. 3119/3120 B.W. | Flame-retardance B.S. 3119/3120 A 20 W 40 | Flame-retardance B.S. 3119/3120 A 25 W 60 | Oil Rating AATCC 118-1975 B.W. | Oil Rating AATCC 118-1975 A 20 W 40 | Oil Rating AATCC 118-1975 A 25 W 60 | Spray Rating B.S. 3702 B.W. W.I. | Spray Rating B.S. 3702 B.W. R | Spray Rating B.S. 3702 A 20 W 40 W.I. | Spray Rating B.S. 3702 A 20 W 40 R | Spray Rating B.S. 3702 A 25 W 60 W.I. | Spray Rating B.S. 3702 A 25 W 60 R |
|---|---|---|---|---|---|---|---|---|---|---|---|---|---|---|---|
| | 1% $NaHCO_3$/Zirpro 2 | | | | | | | | | | | | | | |

/ - Treatment from a separate bath
B.W. — Before Washing
A 20 W 40 — After 20 washes at 40° C.
A 25 W 60 — After 25 washes at 60° C., Wascator, liquor ratio 1:10
W.I. — Weight Increase in % during spray test
R - Rating (5 - best, 1 - worst). Oil rating - 8 best, 0 worst
Zirpro 1 - 10% HCl 37%, 4% citric acid, 6% $K_2TiF_6$, 30 min 70° C., liquor ratio 1:25
Zirpro 2 - 10% HCl 37%, 4% citric acid, 6% $K_2TiF_6$, 3% FC 214, 30 min 70° C., liquor ratio 1:25
Synthappret BAP (Bayer) and Neoprene 400 (Du Pont) applied by the pad-dry-cure (5 min, 150° C.) technique.
All concentrations expressed in solids, except FC 214 (3 M Company) - as supplied.

Thus it can be seen that the process of the invention enables a shrink-resistant and flame retardant finish to be applied to wool fabrics by a simple route using commercially available chemicals, without adversely affecting properties such as water-repellency.

EXAMPLES 22 TO 25

In order to compare the finish obtained according to the present invention with the finish obtained with other, chemically similar, but non chlorine containing polymers the following tests were performed. An all wool gabardine fabric, 270 g/m², was treated with 1.25% Synthappret BAP, 1.25% of a polymer as listed below, and 1% $NaHCO_3$ by the pad-dry-cure technique, curing being achieved by heating to 150° C. for five minutes. Thereafter, in a separate long liquor bath, the fabric was subjected to a Zirpro treatment with 10% HCl (37%), 4% citric acid and 8% $K_2ZrF_6$ for 30 minutes at 60° C. at a fabric to liquor ratio of 1:30.

The polymers evaluated were as follows:

| Example No. | Polymer |
|---|---|
| 22 | Neoprene Latex 400 (Du Pont) - chloroprene |
| 23 | Primal K3 (Rohm and Haas) - acrylic polymer dispersion |
| 24 | Acralen BN (BASF) - polymer dispersion based on a butadiene copolymer |
| 25 | Texicote 63-001 (Scott Bader Ltd.) - vinyl acetate based emulsion |

The results are expressed in Table 4 and it can be seen that all treatments imparted adequate shrink resistence. However, only the treatment incorporating the organochlorine containing Neoprene Latex 400 (example 22) in accordance with the present invention imparted adequate flame retardance. The other polymer shrink resist treatments (examples 23 to 25) were not compatible with the Zirpro flame retardant treatment because of the excessive fuel contribution of the polymers. Consequently the fabrics so treated failed the stringent requirements of FAR 25.853B.

TABLE 4

Evaluation of multi-purpose finishes on a 100% wool gaberdine fabric, 270 g/m²

| Example No. | Treatment | Area Felting Shrinkage in % (3 hr. Cubex) | Flame Retardance F.A.R. 25.853 b. B.W. | Flame Retardance F.A.R. 25.853 b. A 20 W 40 |
|---|---|---|---|---|
| — | Untreated | 20% | Fail | Fail |
| 22 | 1.25% Synthappret BAP + 1.25% Neoprene 400 + 1% $NaHCO_3$/Zirpro | 0.1% | Pass | Pass |
| 23 | 1.25% Synthappret BAP + 1.25% Primal K3 + 1% $NaHCO_3$/Zirpro | 0.2% | Fail | Fail |
| 24 | 1.25% Synthappret BAP + 1.25% Acralen BN + 1% $NaHCO_3$/Zirpro | 0.3% | Fail | Fail |
| 25 | 1.25% Synthappret BAP + 1.25 Texicote 63.001 + 1% $NaHCO_3$/Zirpro | 0.3% | Fail | Fail |

/ Treatment from A Separate Bath.
B.W. Before Washing.
A 20 W 40 - after 20 washes at 40° C.
All concentrations expressed in solids.

We claim:

1. A method for finishing keratinous textile articles which comprises applying a mixture of about 0.2 to 2.0% of an anti-felt polymer and about 1.0 to 4.0% of a chlorinated ethylenically unsaturated monomer on said article; drying and curing said article following the application of said mixture on said article; and thereafter applying from about 0.5 to 2.5% of an anionic titanium complex or about 1.0 to 5.0% anionic zirconium complex (calculated as oxide) to said article at a pH of about 4 or less.

2. A method according to claim 1 in which the anti-felt polymer is an isocyanate functional polymer or a bunte salt functional polymer.

3. A method according to claim 2 in which the polymer is a polycarbomyl sulphonate.

4. A method as claimed in claim 2 in which the polymer has the following structure:

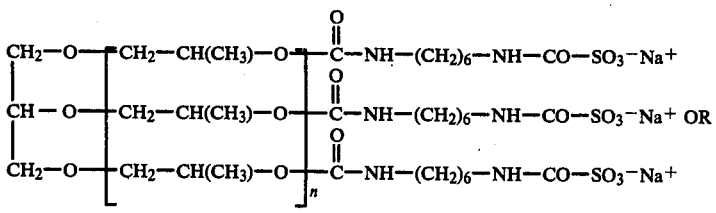

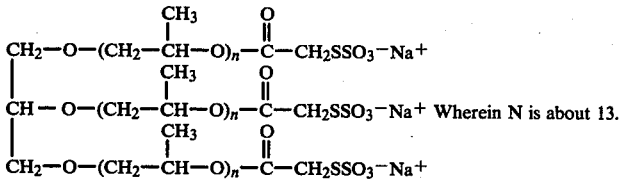

Wherein N is about 13.

5. A method as claimed in claim 1 in which the chlorinated polymer is polyvinylchloride, polyvinylidene chloride, polychloroprene, or dichlorobutadiene.

6. A method as claimed in claim 5 in which the chlorinated polymer is a copolymer of polychloroprene and 2,3-dichloro-1,3-butadiene.

7. A method according to claim 1 in which the titanium or zirconium is applied by exhaustion as an anionic complex with fluoride, citrato, or tartrato ions at a pH in the range of 1 to 4.

8. A method as claimed in claim 1 in which the keratinous fibres are wool fibres.

9. A method as claimed in claim 1 in which the textile article is a fabric.

10. A method as claimed in claim 1 in which the polymers are applied by exhaustion, dipping, spraying or padding.

* * * * *